US012405075B2

(12) United States Patent
Tippmann et al.

(10) Patent No.: US 12,405,075 B2
(45) Date of Patent: Sep. 2, 2025

(54) BELT-FED ROTARY GUN

(71) Applicant: TIPPMANN INDUSTRIAL PRODUCTS, INC., Fort Wayne, IN (US)

(72) Inventors: Bradley Tippmann, Fort Wayne, IN (US); Allen W. Rife, Fort Wayne, IN (US); Daniel Mueller, Fort Wayne, IN (US)

(73) Assignee: Tippmann Industrial Products, Inc., Fort Wayne, IN (US)

( * ) Notice: Subject to any disclaimer, the term of this patent is extended or adjusted under 35 U.S.C. 154(b) by 0 days.

(21) Appl. No.: 18/503,500

(22) Filed: Nov. 7, 2023

(65) Prior Publication Data

US 2024/0263900 A1 Aug. 8, 2024

Related U.S. Application Data

(60) Provisional application No. 63/423,240, filed on Nov. 7, 2022.

(51) Int. Cl.
*F41A 9/36* (2006.01)
*F41A 9/37* (2006.01)

(52) U.S. Cl.
CPC . *F41A 9/36* (2013.01); *F41A 9/37* (2013.01)

(58) Field of Classification Search
CPC ..... F41A 9/29; F41A 9/30; F41A 9/31; F41A 9/32; F41A 9/33; F41A 9/35; F41A 9/36; F41A 9/37; F42B 39/08
See application file for complete search history.

(56) References Cited

U.S. PATENT DOCUMENTS

| | | | | | |
|---|---|---|---|---|---|
| 2,733,640 | A * | 2/1956 | Gilligan | F42B 39/08 | 89/35.01 |
| 2,970,522 | A * | 2/1961 | Brady | F42B 39/08 | 89/35.01 |
| 3,333,506 | A * | 8/1967 | Henshaw | F41A 9/30 | 89/35.02 |
| 3,377,919 | A * | 4/1968 | Clark | F42B 39/08 | 89/35.01 |
| 4,004,491 | A * | 1/1977 | Seeling | F41A 9/31 | 89/35.01 |
| 4,223,590 | A * | 9/1980 | Donovan | F42B 39/08 | 89/35.01 |
| 4,290,339 | A * | 9/1981 | Skahill | F41A 9/31 | 89/33.25 |
| 4,474,102 | A * | 10/1984 | Tassie | F42B 39/08 | 89/33.17 |
| 2022/0205749 | A1* | 6/2022 | Franssen | F41A 9/32 | |

* cited by examiner

*Primary Examiner* — Bret Hayes
(74) *Attorney, Agent, or Firm* — Barnes & Thornburg LLP

(57) ABSTRACT

A belt-fed Gatling-style gun is provided. In some embodiments, the belt-feed system allows a plurality of individually separable belt links to be connected in series to feed cartridges to a belt-fed rotary gun. Each individual belt link may be removably connected to a series of belt links to facilitate ease of loading and making belts of ammunition of any length.

18 Claims, 10 Drawing Sheets

BELT-FED ROTARY GUN

RELATED APPLICATION

This application claims the benefit of U.S. Provisional Application Ser. No. 63/423,240 filed Nov. 7, 2022 for a "BELT-FED ROTARY GUN," which is hereby incorporated by reference in its entirety.

TECHNICAL FIELD

This disclosure generally relates to Gatling-style guns. More specifically, this disclosure relates to a Gatling-style gun that is belt-fed.

BACKGROUND

Rotary cannons, rotary autocannons, rotary guns, and Gatling-style guns, are a type of firearm with a rotating barrel assembly. The barrels fire as the barrel assembly rotates. In some cases, the barrels may be externally driven via an electric motor; some rotary guns are driven via recoil or gas impulse from spent ammunition; some guns are driven with a manual crank.

SUMMARY

According to one aspect, this disclosure provides a belt-feed assembly for feeding cartridges into the chambers of a rotary gun. In some embodiments, this disclosure includes a belt-feed assembly, which could include a plurality of separable belt links. In some cases, each of the separable belt links includes a cartridge holder configured to hold a cartridge, a belt tooth configured to engage with the gun barrel system, and a feed channel configured to accept a feed ram. Depending on the circumstances, the plurality of separable belt links could be made from a belt material with one or more of plastics, natural rubbers, and/or synthetic rubbers.

In some embodiments, the feed ram may engage a cartridge in the cartridge holder, thereby forcing the cartridge into a gun barrel system. For example, the cartridge holder may have a variable size cartridge holder configured to accept a wide variety of different caliber munitions, including, but not limited to, 9 mm, 0.22, 0.223, 5.56 mm, and 7.62 mm.

In some cases, the separable belt links could have a first portion and a second portion. The first portion and the second portion may be configured such that the feed channel is formed between the first portion and the second portion of the separable belt links.

Embodiments are contemplated in which the separable belt links include a belt link connector. For example, the belt link connector of the separable belt links could have a hook portion and a rail portion. The hook portion of the separable belt links may be configured to engage with the rail portion of the separable belt links such that a continuous belt is formed by joining multiple separable belt links together. The belt tooth could be configured to engage with a belt tooth acceptor on the gun barrel system such that the belt tooth on the separable belt links is drawn into the gun barrel system sequentially.

Depending on the circumstances, the system might have a lock door. For example, the lock door could include a feed tray configured to accept the separable belt links.

According to another aspect, this disclosure provides a system for feeding cartridges to a rotary gun. In some embodiments, the system may have a delivery vehicle with a plurality of separable belt links. In some cases, each of the plurality of separable belt links has a cartridge holder configured to hold a cartridge. Each of the plurality of separable belt links may have a belt tooth configured to engage with the gun barrel system. Additionally, in some embodiments, each of the plurality of separable belt links includes a feed channel configured to accept a feed ram. During operation, the delivery vehicle could orient cartridges with respect to the gun barrel system, feed cartridges by being pulled through the gun barrel system via the belt tooth on each belt link, load a cartridge into the gun barrel system by injecting it in the gun barrel system via a feed ram, and eject from the gun barrel system.

According to a further aspect, this disclosure provides a method for belt-feeding a rotary gun. In some embodiments, the method includes orienting a cartridge within a reusable modular belt. The reusable modular belt is fed to a rotary gun via a series of belt teeth on the reusable modular belt. For example, the belt teeth on the reusable modular belt could be configured to slot into a gun barrel system such that they are pulled through the gun barrel system. The method may include the step of loading the cartridge into the gun barrel system via a feed ram. In some cases, the feed ram is configured to pass through a central channel in the reusable modular belt and disengage the cartridge from the reusable modular belt. The method may also include injecting the cartridge into the gun barrel system, and ejecting the reusable modular belt from the rotary gun.

BRIEF DESCRIPTION OF THE DRAWINGS

The present disclosure will be described hereafter with reference to the attached drawings which are given as non-limiting examples only, in which.

Figure 1:
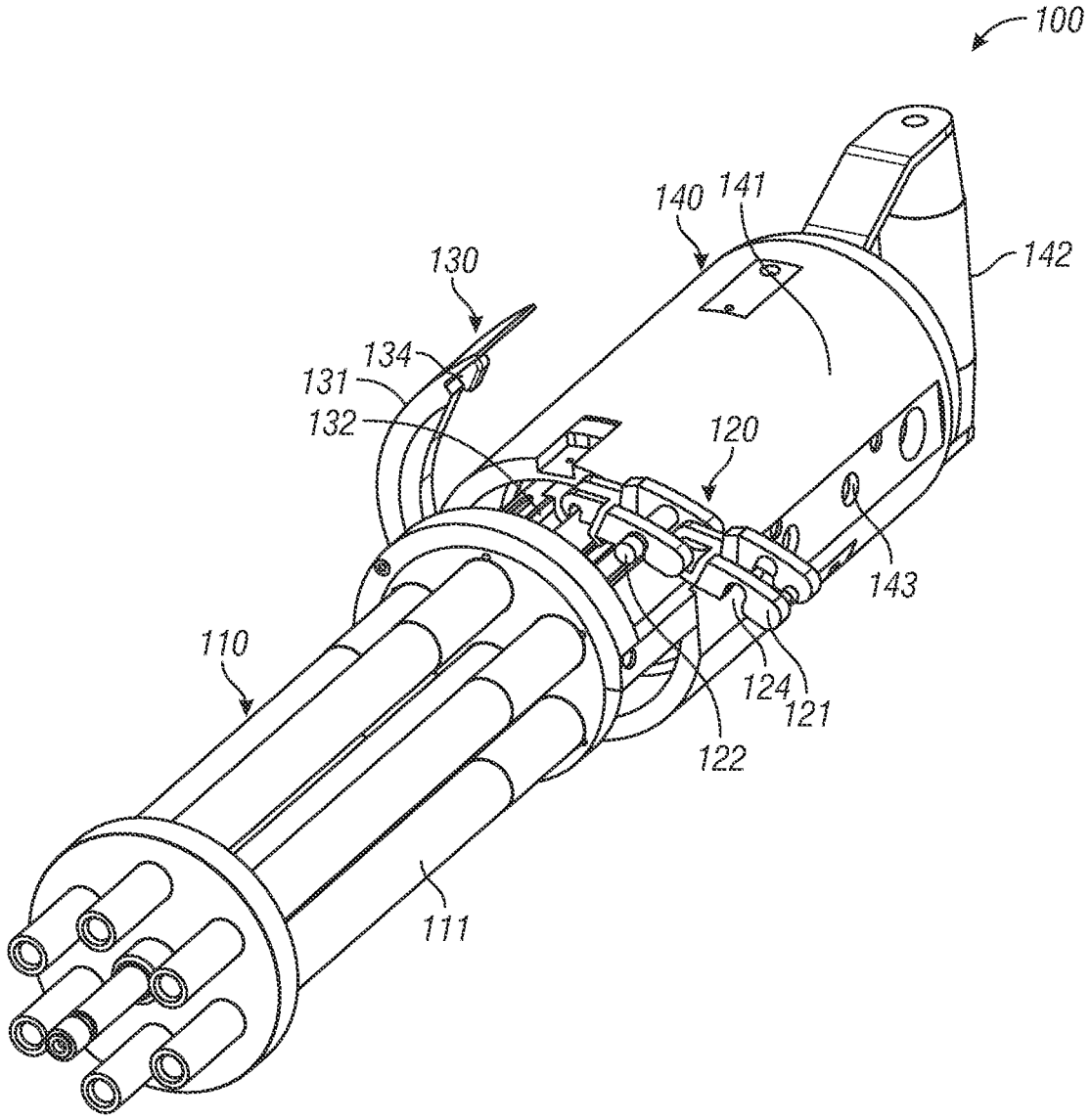
FIG. 1 is a perspective view of an example belt-fed rotary gun according to an embodiment of this disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The present disclosure is directed towards a belt-fed rotary gun. In some embodiments, this disclosure provides a technical advantage of having an adjustable length belt assembly. This allows the user to determine how many cartridges to feed the gun. For example, the belt assembly could be adjusted between X links and Y links to adjust the number of cartridges fed into the gun from X cartridges to Y cartridges, similar to how magazines have different capacities. Another technical advantage, in some embodiments, is the direct feed of the belt assembly into the gun's chambers; instead of the belt placing the cartridges into another feed mechanism that inserts the cartridge into the chamber, the belt assembly in some embodiments directly deposits cartridges into the chambers for firing. For example, each link in the belt assembly could drop a cartridge via gravity feed directly into respective chambers of the gun as the belt is fed through the gun.

Turning to FIG. 1, an example embodiment of a rotary gun 100 is shown. As shown, the rotary gun 100 has a gun barrel system 110, a belt-feed assembly 120, a gun lock system 130, and a gun drive system 140.

In the embodiment shown, the gun barrel system 110 includes a plurality of barrels 111 arranged in a cyclic array. As the barrels 111 rotate, the rotary gun 100 fires providing saturational directional fire. As shown, the belt-feed assembly 120 is formed from a plurality of individual belt links 121. The individual belt links 121 may be joined together to form a continuous belt with any number of individual belt links 121. Each belt link 121 has a cartridge holder 124 built into the belt link 121. The cartridge holder 124 is configured to accept and retain a cartridge 122 which the belt-feed assembly 120 cycles through the rotary gun 100.

As shown, the gun lock system 130 has a lock door 131 and a gun firing assembly 132. The lock door 131 covers the gun firing assembly 132 during operation and prevents dirt and grime from agglomerating in the gun lock system 130. Additionally, the lock door 131, in some embodiments, may be removable such that jams in the gun firing assembly 132 during operation may be cleared quickly. The belt-feed assembly 120 is cycled through the gun lock system 130 to load the rotary gun 100 during operation. The gun firing assembly 132 is the location where the cartridge 122 is disengaged from the cartridge holder 124 in the belt link 121 and deposited into a chamber 135 (FIG. 10) of the gun lock system 130. Each of the plurality of barrels 111 has a chamber 135. In the embodiment shown, the gun lock system 130 also has a feed ram 134 which disengages the cartridge 122 from the belt link 134 and effectively loads the rotary gun 100.

The gun drive system 140 drives the rotation of the barrels 111 during operation. In some embodiments, the gun drive system 140 includes a handle 142 and mounting holes 143 that allow the rotary gun 100 to be mounted and used by an operator. As shown, the gun drive system 140 also has a drive unit 141. The drive unit 141 may be gas or recoil actuated, electrically actuated via a motor (not shown), or manually actuated via a crank handle (not shown).

Figure 2:
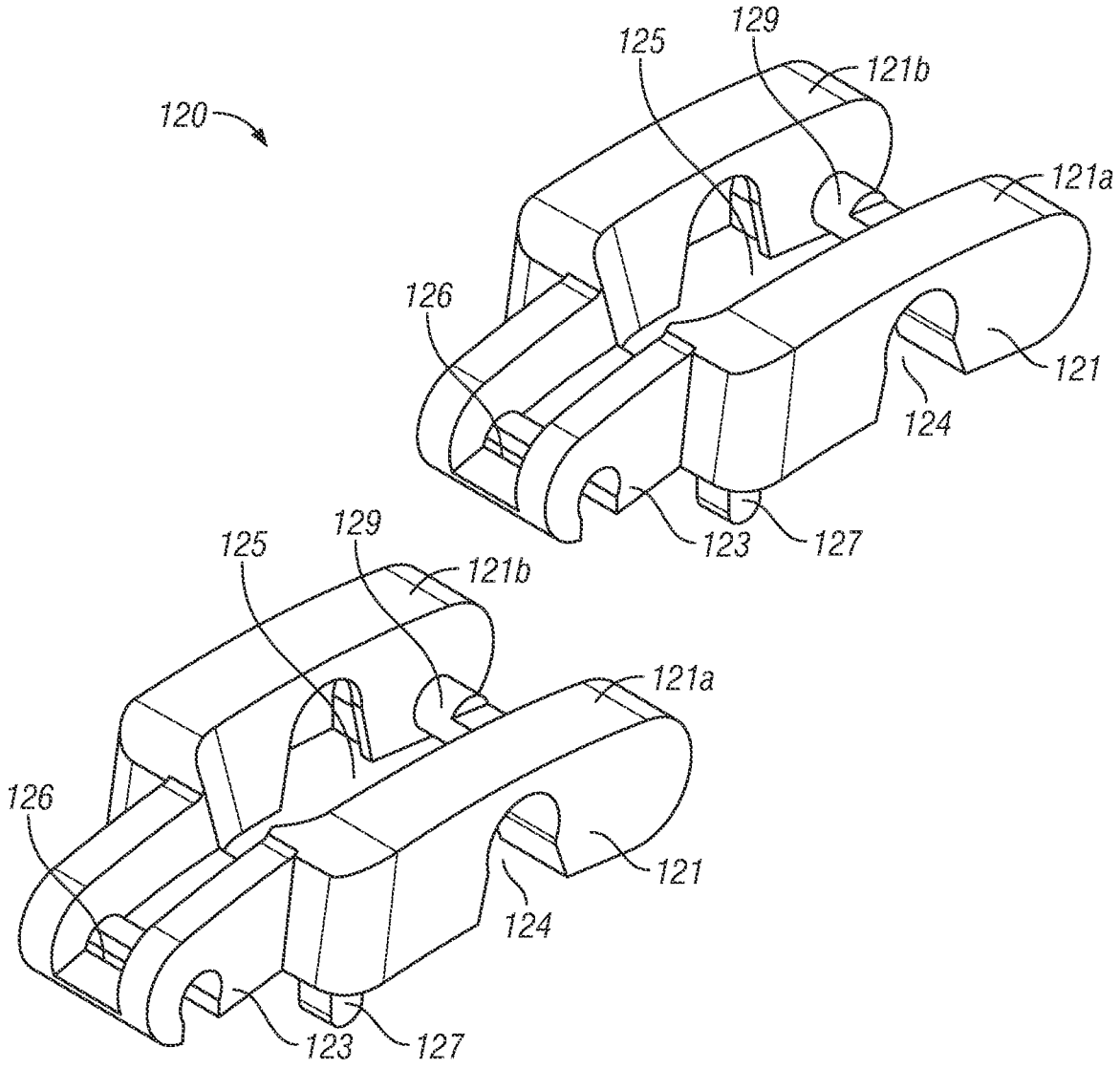
FIG. 2 is a perspective view of two example belt links that could be part of a belt assembly for feeding cartridges into the belt-fed rotary gun of FIG. 1 according to an embodiment of this disclosure.

Turning next to FIG. 2, an example embodiment of a belt-feed assembly 120 is shown. As shown, the belt-feed assembly 120 includes a plurality of connected belt links 121. In some embodiments, the connected belt links 121 further comprise a first portion 121*a* and a second portion 121*b*. The first portion 121*a* and second portion 121*b* are substantially parallel. Any number of individual belt links 121 may be connected together to form a belt-feed assembly 120 with a belt of any length. For example, individual belt links could have a cartridge holder 124 configured to accept a cartridge 122 of varying size. The cartridge holder 124 may be in the shape of a semicircular detent. Any number of different size cartridges may be used, including, but not limited to, 9 mm, 0.22, 0.223, 5.56 mm, and 7.62 mm.

In the embodiment shown, each belt link 121 includes at least one belt tooth 127. The belt tooth 127 engages with the gun barrel system 110. The belt tooth 127 of a first belt link 121 is spatially distanced from the belt tooth 127 of a second belt link 121 such that they match with a plurality of indents on the gun barrel system 110. The gun barrel system 110 draws the belt links 121 through the rotary gun 100 during operation, effectively allowing for a continuous influx of cartridges 122 to the rotary gun 100, which in turns provides for continuous saturational directional fire from the rotary gun 100. As shown, the belt links 121 also have a feed channel 125 which allows for the feed ram 134 to disengage the cartridge 122 from the belt link 121 during operation. The feed channel 125 is formed between the first portion 121*a* and second portion 121*b* on the belt link 121. In some embodiments, the belt link 121 also has a belt connector 123 which allows multiple belt links 121 to be joined together to form belts of varying lengths depending on the needs of the operator. The belt connector 123 further includes a belt hook 126 which is designed to slot on to a belt rail 129 on an adjoining belt link 121 in a rotatable manner. The belt rail 129, in some embodiments, is substantially cylindrical. This linkage allows belts of varying lengths to be quickly and easily assembled and disassembled, and does not require any specialized tools.

Figure 3:
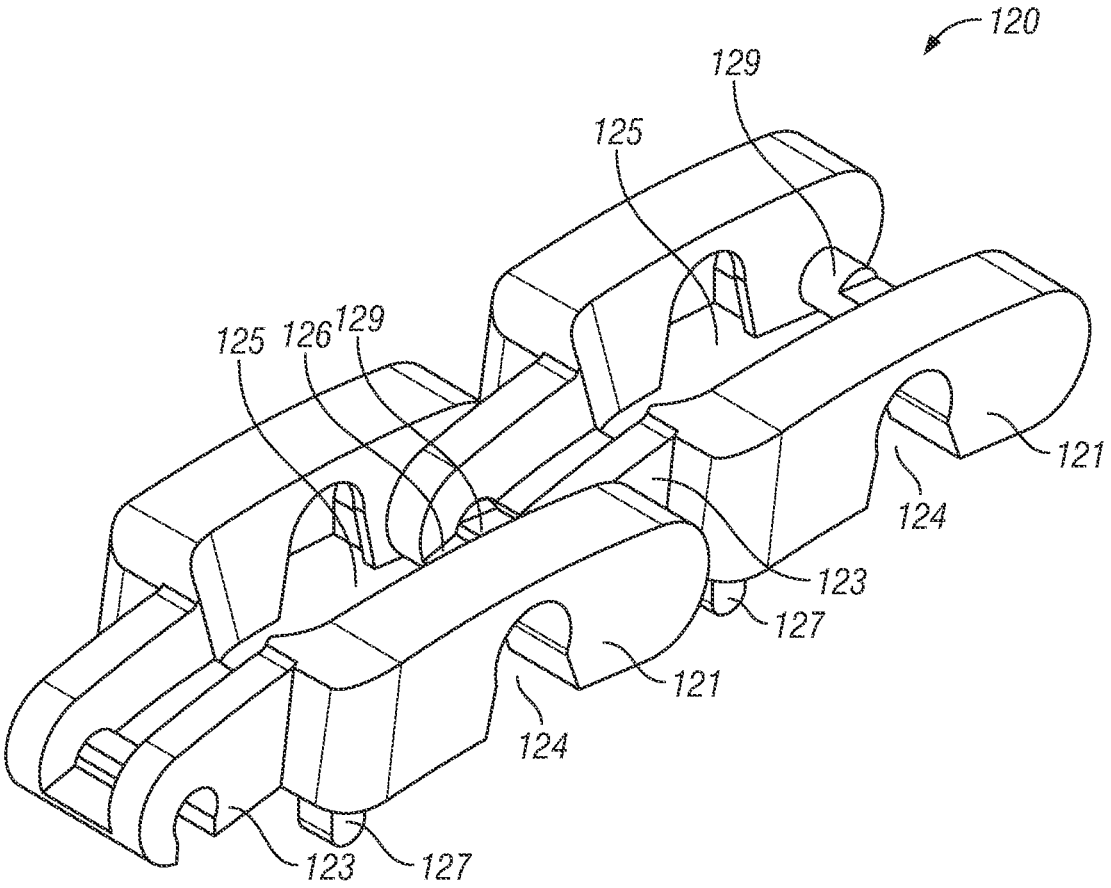
FIG. 3 is a perspective view of the example belt links of FIG. 2 connected together according to an embodiment of this disclosure.
Figure 4:
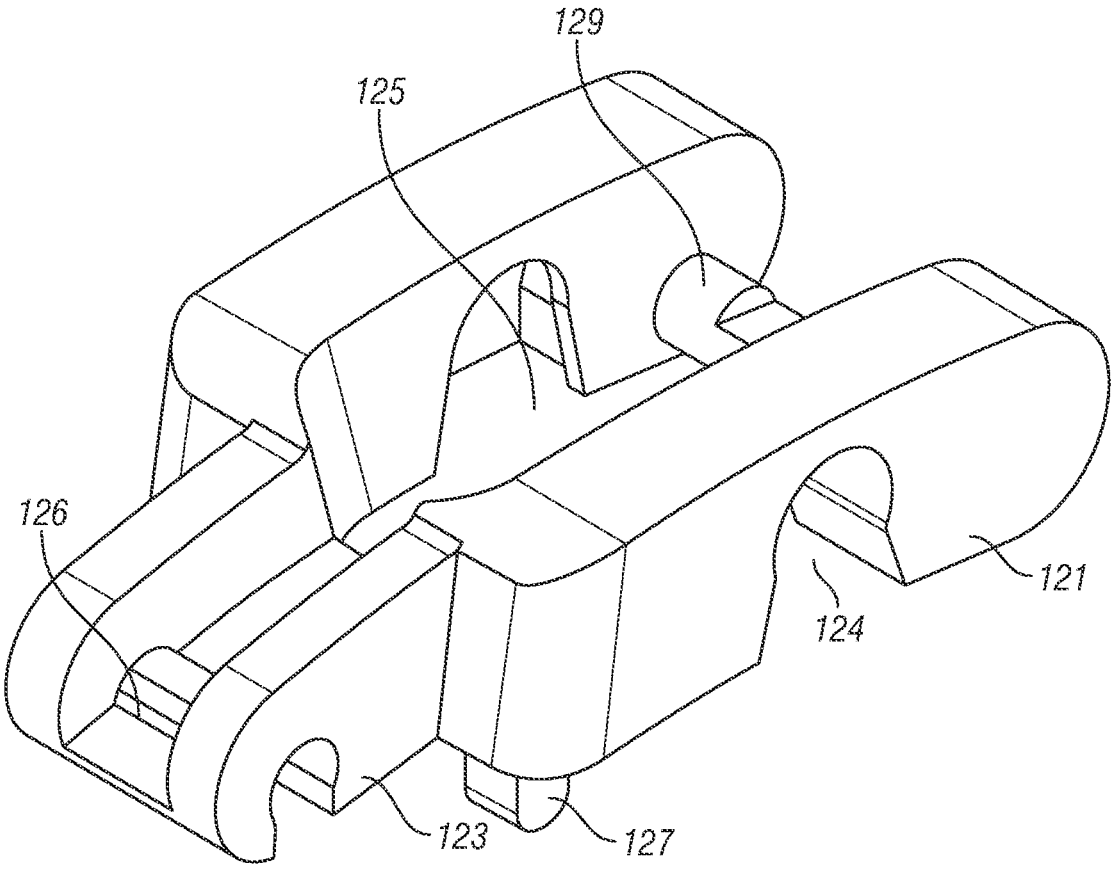
FIG. 4 is a perspective view of a single belt link that could form a portion of a belt assembly according to an embodiment of this disclosure.

Turning next to FIG. 3, the linkage between two individual belt links 121 is shown. The belt hook 126 of the belt connector 123 is shown slotted over the belt rail 129 of the adjoining belt link 121. FIG. 4 further shows a single belt link according to this embodiment in detail.

Figure 5:
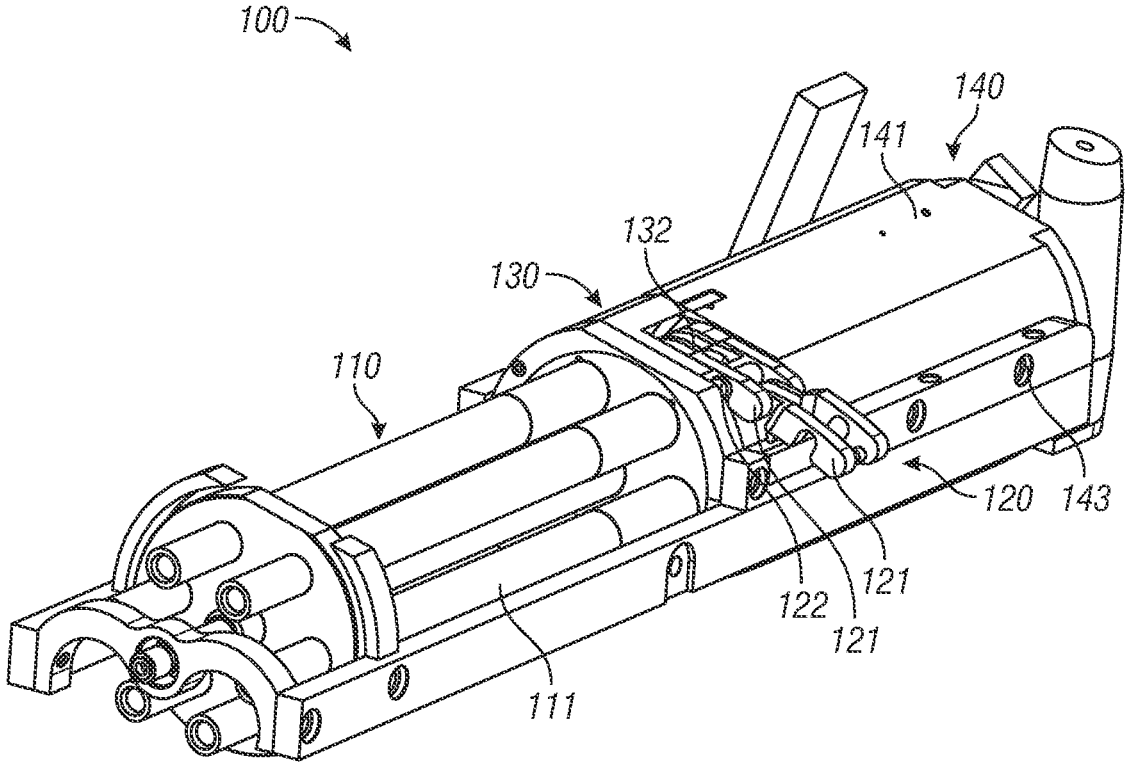
FIG. 5 is a perspective view of an example belt assembly within the belt-fed rotary gun of FIG. 1 as it is loading a cartridge in a first position.

FIG. 5 shows the rotary gun 100. The belt links 121 containing the cartridge 122 are in a first position where the cartridge 121 in the belt link 121 has not yet been disengaged from the belt link 121 via the feed ram 134 and inserted into the gun firing assembly 132.

Figure 6:
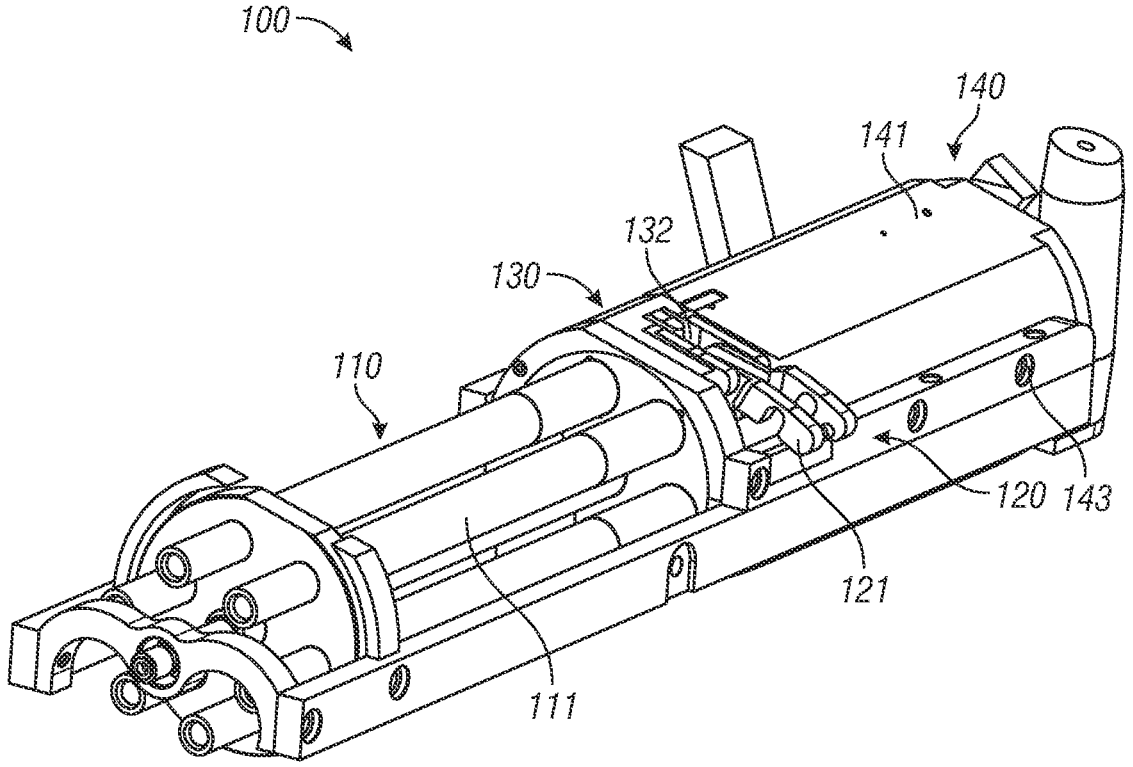
FIG. 6 is a perspective view of the example belt assembly within the belt-fed rotary gun of FIG. 1 as it is loading a cartridge in a second position.

FIG. 6 shows the rotary gun 100 in a second position where the cartridge 122 has been disengaged from the belt link 121 by the feed ram 134 and inserted into the chamber 135 within the gun firing assembly 132. In the second position, the barrel 111 of the gun barrel system 110 is in a position such that it is ready to be fired.

Figure 7:
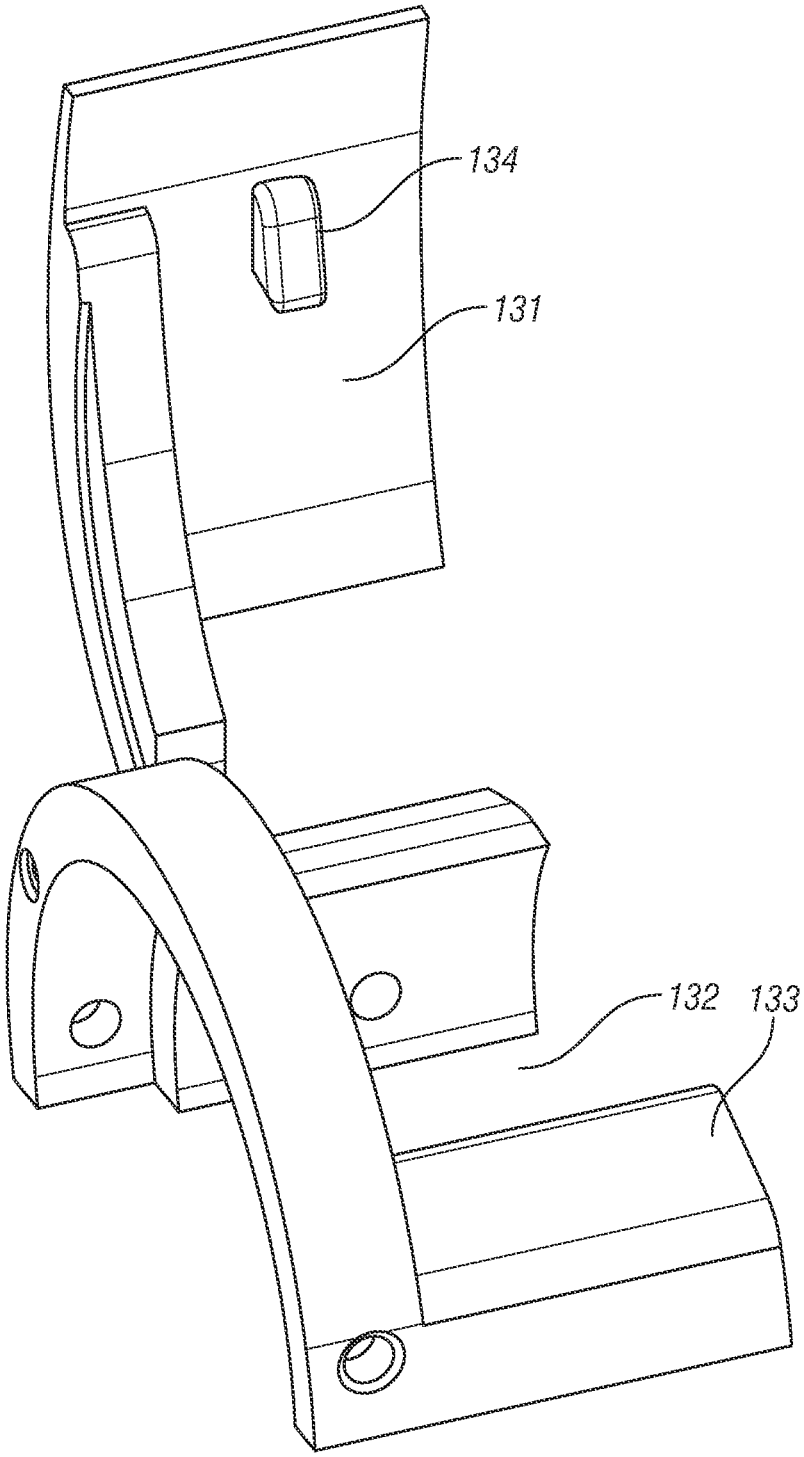
FIG. 7 is a perspective view of an example lock door within the belt-fed rotary gun of FIG. 1 according to an embodiment of this disclosure.

Turning next to FIG. 7, a lock door 131 is shown. The lock door 131 covers the gun firing assembly 132 and each chamber 135 during operation of the rotary gun 100. The lock door 131 covers the gun firing assembly 132 during operation and prevents dirt and grime from agglomerating in the gun lock system 130. The lock door 131, in some embodiments, is removable such that any jams during operation of the rotary gun 100 may be cleared quickly and efficiently on the field. The lock door 131 further comprises the feed ram 134 which disengages the cartridge from the belt link 121 and forces it into the gun lock system 130. The lock door 131 is connected to the gun lock system 130 via a feed tray 133. The feed tray 133 guides the belt links 121 and cartridges 122 into the gun firing assembly 132 in preparation for loading the rotary gun 100.

Figure 8:
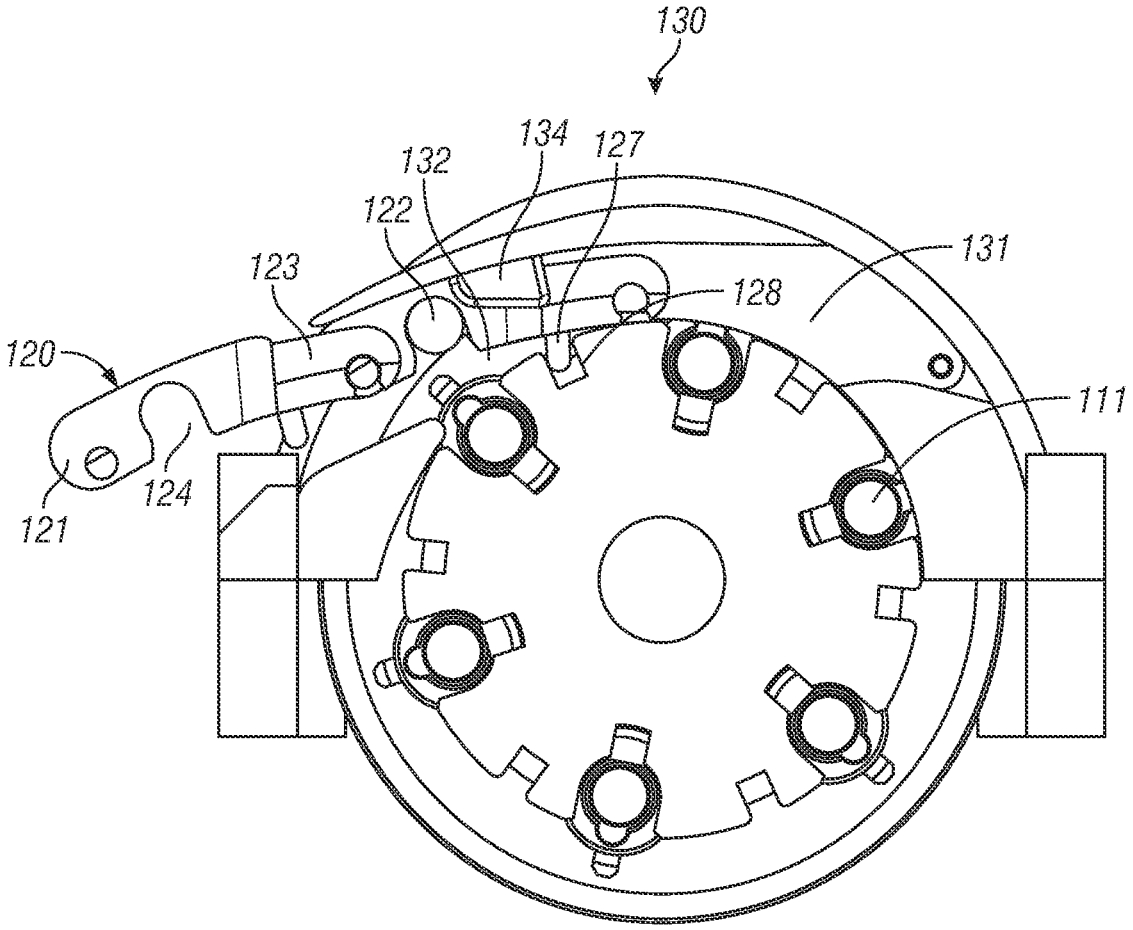
FIG. 8 is a cross-sectional view of the belt assembly within the belt-fed rotary gun of FIG. 1 as it is loading a cartridge in a first position.
Figure 9:
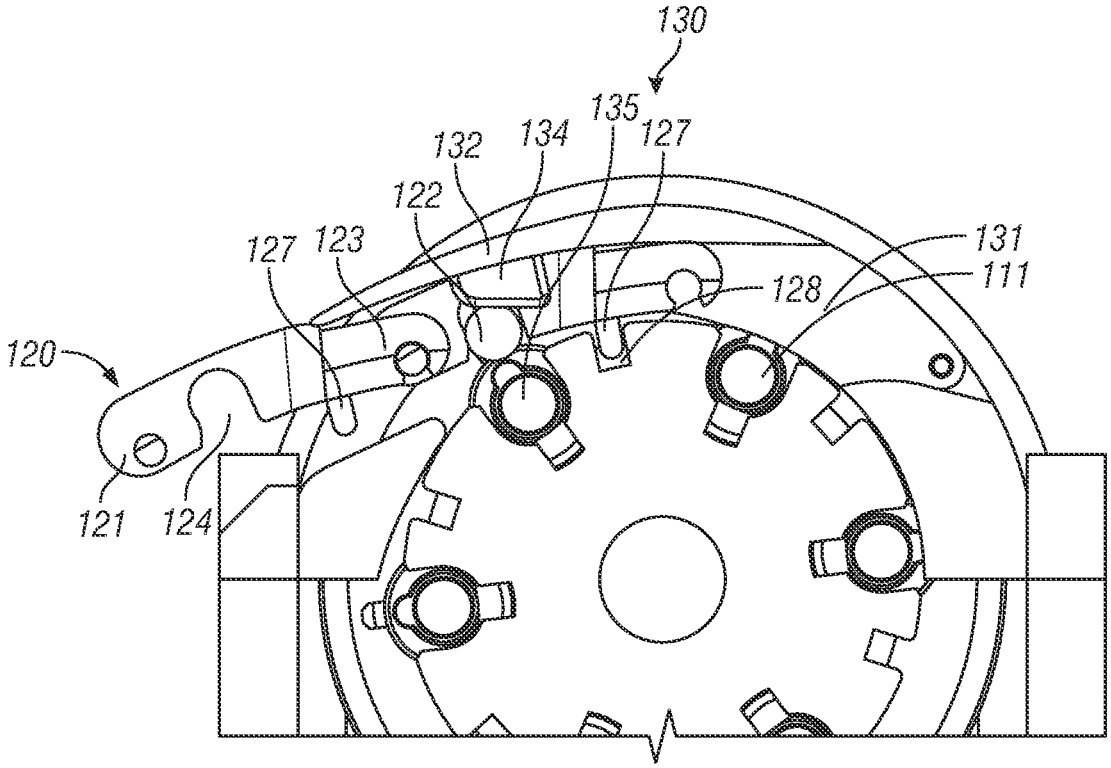
FIG. 9 is a detailed view of the cross-section shown in FIG. 8 as the gun loads a cartridge in a second position.
Figure 10:
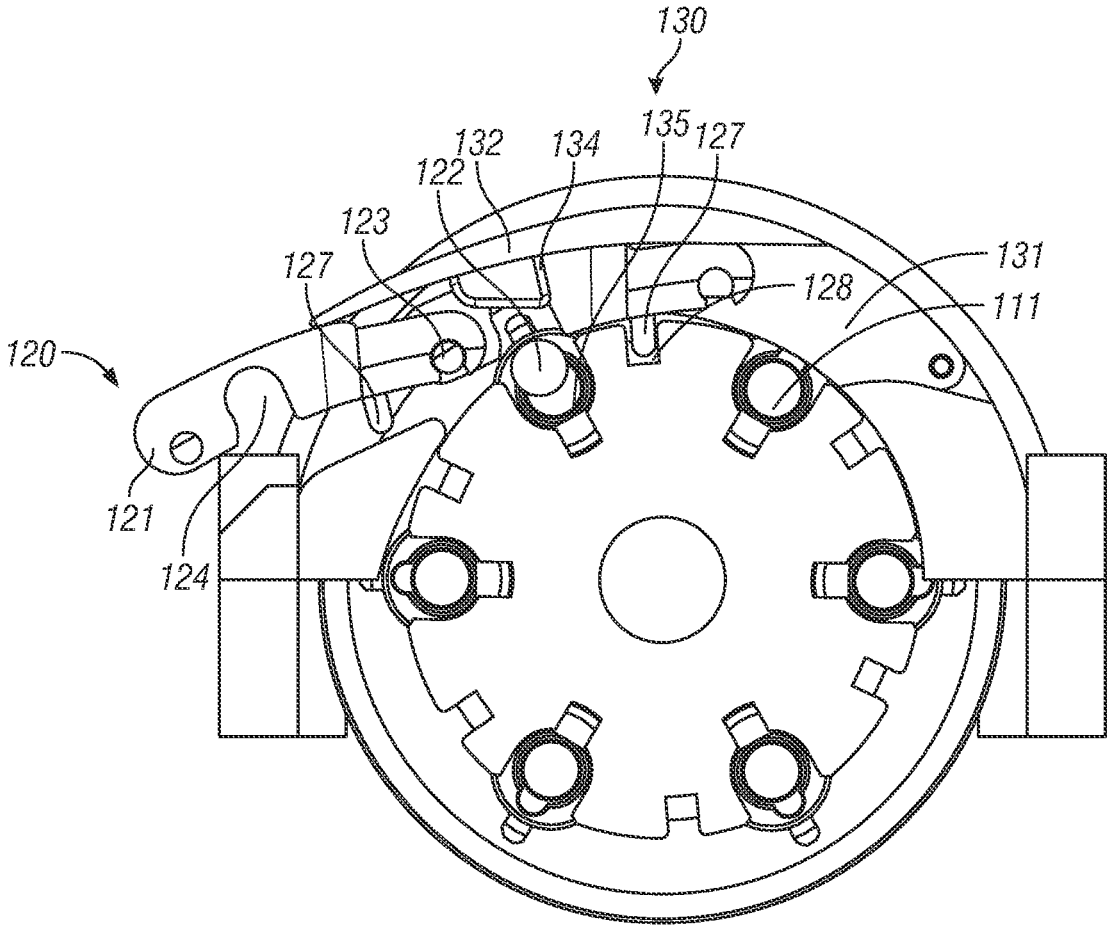
FIG. 10 is a detailed view of the cross-section shown in FIG. 9 as the gun loads a cartridge in a third position.

FIGS. 8-10 are progressive views showing the belt-feed assembly 120 depositing a cartridge into a chamber via the gun firing assembly 132 according to an embodiment. FIG. 8 shows the loading process in a first position. The belt links 121 are fed into the gun lock system 130 via the feed tray 133. The belt links 121 are joined together via the belt hook 126 and belt rail 129 forming a continuous belt which allows for consistent and continuous feed to the gun lock system 130. In the first position, the cartridge 122 is still engaged to the belt link 121 via the cartridge holder 124. The feed ram 134 has not disengaged the cartridge 122 and deposited it into the gun firing assembly 132 and chamber 135 in the first position. The belt tooth 127 is engaged to the gun barrel system 110 via a belt tooth acceptor 128. The belt tooth acceptor 128 pulls the belt links 121 via the belt tooth 127 located on each belt link 121 into the gun barrel system 110 and gun lock system 130. The continuous feed of cartridges via the belt links 121 and this mechanism allow for continuous saturational directional fire of the rotary gun 100 during operation.

FIG. 9 shows the loading process in a second position. The belt link 121, via the belt tooth 127 being pulled forward into the gun lock system 130 by the belt tooth acceptor 128 on the gun barrel system, has advanced forward into the gun firing assembly 132. The cartridge 122 contained in the cartridge holder 124 has engaged the feed ram 134. The feed ram 134 has begun to disengage the cartridge 122 from the cartridge holder 124 on the belt link 121. The cartridge 122 has started to be forced into the chamber 135 in the gun firing mechanism 132 in the first position. The belt-feed assembly 120 is pulled into the gun lock system 130 by the belt tooth 127 engaging with the belt tooth acceptor 128.

FIG. 10 shows the loading process in a third position. In the third position, the feed ram 134 has disengaged the cartridge 122 from the cartridge holder 124 on the belt link 121. The cartridge 122 has been injected into the gun lock system 130 via the gun firing assembly 132 and chamber 135 within the respective barrel 111 being loaded. The lock door covers the gun lock system 130 during operation. Once the cartridge 122 has been fully disengaged from the belt link 121 and injected into the gun lock system 130, the barrel 111 rotates to the firing position and the cartridge 122 is fired. The barrel 111 continues rotating and ejects the cartridge 122 after firing as well as ejects the belt link 121 after the cartridge 122 has been disengaged from the belt link 121. The belt link 121 after being ejected from the rotary gun 100 can be reused. This simplified loading system for injecting cartridges 122 into the gun lock system 130 reduces the amount of maintenance needed because there are fewer moving parts in the gun lock system 130 and belt-feed assembly 120 than in the prior art. It is advantageous to have easier serviceability with fewer parts to ensure the rotary gun 100 can be easily maintained and serviced in the field.

It is to be understood that the invention is not limited to the exact details of construction, operation, exact materials or embodiments shown and described, as obvious modifications and equivalents will be apparent to one skilled in the art. While the specific embodiments have been illustrated and described, numerous modifications come to mind without significantly departing from the spirit of the invention, and the scope of protection is only limited by the scope of the accompanying Claims.

What is claimed is:

1. A rotary gun comprising:

belt-feed assembly configured to feed ammunition through the rotary gun, the belt feed assembly comprising:

(i) a first belt link comprising a first elongated side and a second elongated side, wherein the first elongated side of the first belt link is substantially parallel to the second elongated side of the first belt link, wherein the first elongated side of the first belt link further comprises a first semicircular detent configured to secure a cartridge, wherein the second elongated side of the first belt link further comprises a second semicircular detent configured to secure a cartridge, wherein the first elongated side of the first belt link is connected to the second elongated side of the first belt link with a substantially cylindrical cross member, wherein the first belt link comprises a hook opposite the substantially cylindrical cross member, (ii) a second belt link comprising a first elongated side and a second elongated side, wherein the first elongated side of the second belt link is substantially parallel to the second elongated side of the second belt link, wherein the first elongated side of the second belt link further comprises a first semicircular detent configured to secure a cartridge, wherein the second elongated side of the second belt link further comprises a second semicircular detent configured to secure a cartridge, wherein the first elongated side of the second belt link is connected to the second elongated side of the second belt link with a substantially cylindrical cross member, wherein the second belt link comprises a hook opposite the substantially cylindrical cross member, wherein the hook on the second belt link is configured to be attached to the substantially cylindrical cross member of the first belt link; and a gun firing assembly including a feed ram configured to sequentially disengage cartridges fed into the rotary gun by the belt-feed assembly.

2. The rotary gun of claim 1, wherein the first belt link and second belt link further comprise a plurality of belt teeth.

3. The rotary gun of claim 2, wherein the plurality of belt teeth of the first belt link and the second belt link are spatially arranged to engage with a plurality of indents in a barrel system of the rotary gun.

4. The rotary gun of claim 3, wherein the plurality of indents in a barrel system of a gun are configured to pull the first belt link and second belt link sequentially into the rotary gun.

5. The rotary gun of claim 1, wherein the first semicircular detent and second semicircular detent of the first belt link further comprise variable size semicircular detents configured to accept a variety of different munitions.

6. The rotary gun of claim 1, wherein the first semicircular detent and second semicircular detent of the second belt link further comprise variable size semicircular detents configured to accept a variety of different munitions.

7. The rotary gun of claim 1, wherein the first belt link and second belt link further comprise a belt material, and wherein the belt material is selected from one or more of: plastics, natural rubbers, and/or synthetic rubbers.

8. The rotary gun of claim 1, wherein the first elongated side and the second elongated side are configured to flex along an axis transverse to an longitudinal axis of the first elongated side and the second elongated side.

9. The rotary gun of claim 8, wherein the feed ram engages a cartridge in the first semicircular detent and second semicircular detent of the first belt link forcing the cartridge into a gun barrel system.

10. The rotary gun of claim 8, wherein the feed ram engages a cartridge in the first semicircular detent and second semicircular detent of the second belt link forcing the cartridge into a gun barrel system.

11. The rotary gun of claim 1, wherein the first elongated side and the second elongated side of the first belt link are configured to form a feed channel between the first elongated side and the second elongated side of the first belt link.

12. The rotary gun of claim 1, wherein the first elongated side and the second elongated side of the second belt link are configured to form a feed channel between the first elongated side and the second elongated side of the second belt link.

13. The rotary gun of claim 1, wherein the rotary gun further comprises a lock door.

14. The rotary gun of claim 13, wherein the lock door further comprises a removable lock door.

15. The rotary gun of claim 14, wherein the lock door further comprises a feed tray configured to guide the first belt link and second belt link into a gun barrel system.

16. A method for belt-feeding a rotary gun, the method comprising:

orienting a cartridge within a reusable modular belt link on a reusable modular belt, feeding the reusable modular belt to a rotary gun via a series of belt teeth on the reusable modular belt, wherein the belt teeth on the reusable modular belt are configured to slot into a gun barrel system such that the series of belt teeth are pulled through the gun barrel system, loading the cartridge into the gun barrel system via a feed ram, wherein the feed ram is configured to pass through a central channel in the reusable modular belt and disengage the cartridge from the reusable modular belt, and further inject said cartridge into the gun barrel system, and ejecting the reusable modular belt from the rotary gun.

17. The method of claim 16, further comprising connecting a plurality of reusable modular belt links in series to form the reusable modular belt.

18. The method of claim 16, further comprising reusing the plurality of reusable modular belt links in series to form the reusable modular belt.

* * * * *